US006632267B1

(12) United States Patent
Ilmasti

(10) Patent No.: US 6,632,267 B1
(45) Date of Patent: Oct. 14, 2003

(54) METHOD AND DEVICE FOR SEPARATING MATERIALS IN THE FORM OF PARTICLES AND/OR DROPS FROM A GAS FLOW

(76) Inventor: Veikko Ilmasti, Töllinmäki 10 A, FIN-00640 Helsinki (FI)

( * ) Notice: Subject to any disclaimer, the term of this patent is extended or adjusted under 35 U.S.C. 154(b) by 0 days.

(21) Appl. No.: 09/914,730

(22) PCT Filed: Mar. 3, 2000

(86) PCT No.: PCT/FI00/00168

§ 371 (c)(1),
(2), (4) Date: Sep. 20, 2001

(87) PCT Pub. No.: WO00/53325

PCT Pub. Date: Sep. 14, 2000

(30) Foreign Application Priority Data

Mar. 5, 1999 (FI) ..... 990484

(51) Int. Cl.[7] ..... B03C 3/49; B03C 3/64; B03C 3/70; B03C 3/78

(52) U.S. Cl. ..... 95/59; 55/DIG. 38; 95/75; 96/44; 96/49; 96/69; 96/88; 96/97; 96/99

(58) Field of Search ..... 96/88, 99, 97, 96/44, 69, 49; 95/59, 75; 55/DIG. 38

(56) References Cited

U.S. PATENT DOCUMENTS

| | | | | | |
|---|---|---|---|---|---|
| 1,992,113 | A | * | 2/1935 | Anderson | 96/88 |
| 3,157,479 | A | * | 11/1964 | Boles | 96/88 X |
| 3,583,754 | A | * | 6/1971 | Von Berckheim | 96/88 X |
| 3,755,611 | A | * | 8/1973 | Queck et al. | 96/88 X |
| 3,890,103 | A | | 6/1975 | Konishi | 95/71 X |
| 3,970,437 | A | | 7/1976 | Van Diepenbroek et al. | 96/61 |
| 4,010,011 | A | | 3/1977 | Reif | 96/61 |
| 4,077,782 | A | * | 3/1978 | Drummond et al. | 96/99 X |
| 4,477,268 | A | * | 10/1984 | Kalt | 96/99 |
| 5,084,078 | A | * | 1/1992 | Suzuki et al. | 96/88 X |
| 6,071,330 | A | * | 6/2000 | Matsubara et al. | 96/88 X |
| 6,228,148 | B1 | * | 5/2001 | Aaltonen et al. | 96/44 X |

FOREIGN PATENT DOCUMENTS

| | | | |
|---|---|---|---|
| DE | 368519 | | 2/1923 |
| DE | 1 471 620 | | 5/1969 |
| DE | 197 51 984 | | 5/1999 |
| EP | 424335 | * | 4/1991 |

* cited by examiner

*Primary Examiner*—Richard L. Chiesa
(74) *Attorney, Agent, or Firm*—Smith-Hill and Bedell

(57) ABSTRACT

The invention relates to a method and device for separating materials in the form of particles and/or drops from a gas flow, in which method the gas flow is directed through a collection chamber the outer walls of which are grounded, and in which high tension is directed to the ion yield tips arranged in the collection chamber, thus providing an ion flow from the ion yield tips towards the collection surfaces, separating the desired materials from the gas flow. It is characteristic of the invention that the collection surfaces conducting electricity are electrically insulated from the outer casings; and that high tension with the opposite sign of direct voltage as the high tension directed to the ion yield tips is directed to the collection surfaces. According to an embodiment of the invention the electrical insulation is made of ABS, and the surface conducting electricity comprises a thin chrome layer arranged on the insulation layer.

18 Claims, 3 Drawing Sheets

METHOD AND DEVICE FOR SEPARATING MATERIALS IN THE FORM OF PARTICLES AND/OR DROPS FROM A GAS FLOW

BACKGROUND OF THE INVENTION

The present invention relates to a method for separating materials in the form of particles and/or drops from a gas flow, in which method the gas flow is directed through a collection chamber, the outer walls of which are grounded; and in which method high tension is applied to ion yield tips arranged in the collection chamber so that an ion beam separating the desired materials from the gas flow is achieved towards the walls working as collection surfaces. The invention also relates to a device for applying the said method.

At present, filters, cyclones or electrical methods, such as electric filters or an ion blow or beam method, are used in gas purification systems and for separating particles from a gas flow.

When using filters, speed of the flowing gas has to be kept low in fabric or metal filters, because increasing the speed generates a strong air resistance. Also the resolution of the filters decreases along with the increase in speed. For example with micro filters, the gas flow speed is principally smaller than 0.5 m/second. In addition, it is not possible to achieve good cleaning results with the known techniques, when particles of nanometric category are concerned (i.e. particles the diameter of which is from a nanometer to a few dozen nanometers).

The operation of the cyclones is based on the decrease in the gas flow speed so that heavy particles in the gas flow fall down into the collection organ. Cyclones are thus applicable for separating heavy particles, because these have a high falling speed.

In electric filters, the separation of particles from gas is carried out onto collection plates or to interior surfaces of pipes. The speed of the flowing gas in electric filters has to be generally under 1.0 m/second, manufacturers' recommendations being about 0.3–0.5 m/second. The reason for a small gas flow speed is that a higher flow speed releases particles accumulated onto plates, causing the resolution to decrease considerably. The operation of electric filters is based on the electrostatic charge of particles. However, it is not possible to electrically charge particles in the nanometric category. In addition, all materials are not charged electrically, as for example stainless steel.

In electric filters, low gas flow speed has to be used also because of the cleaning stage of the collection plates. When cleaning the plates, a blow is directed to the plates, releasing the collected particle material. The intention is that only the smallest possible amount of particle material released from the plates during the purification stage would get back to the flowing gas. With a small gas flow speed it is possible to achieve tolerable particle passing throughs.

The known technique is next described referring to the enclosed drawings, in which FIG. 1 shows the equipment used in the ion blow method according to the known technique; and FIG. 2 shows a method of the known technique for purifying the gas with the ion blow method.

In FIG. 1, there is shown an equipment for purifying gas in accordance with the known technique. The equipment shown comprises an inlet 1 for the incoming gas to be purified, an outlet 2 for the purified gas, a voltage cable 3, an insulator 4, a grounded collection chamber 5, an energized fastening rod 6, comprising several ion yield tips 7, a vibrator arrangement 8, a recovery channel 9 for collected particles, and a voltage source 10.

In FIG. 1, for example, air coming into a building or air to be recycled is directed to the collection chamber 5 for purification. The air to be purified gets into the collection chamber 5 through the inlet 1, rises upwards and, after purification, leaves through the outlet 2. The purification is carried out by ionizing the gas with ion yield tips 7 arranged to the energized fastening rod 6 and connected to the voltage source 10 via the voltage cable 3, the voltage source 10 being able to apply positive or negative (as in the figure) high tension to the fastening rod 6.

In other words, an ion blow is directed to the gas either positive or negative, and the ions and charged particles as well as uncharged particles are carried to the collection surface 5 along with the ion blow. The ion producing tips 7 are directed towards the grounded collection chamber 5 acting as the collection surface for the particles. The collection chamber 5 is insulated from the energized parts 6, 7 by the insulator 4. A voltage of about 70–150 kV is fed to the ion yield tips 7, and the distance of these from the collection chamber 5 is arranged so as to generate a conical ion blow effect so that the charged and uncharged particles are carried to the wall of the collection chamber 5 and adhere to it due to the charge difference between the 0 charge of the wall of the collection chamber 5 and the charge of the ion blow. The distance between the ion yield tips and the collection wall 5 is typically 200–800 mm.

FIG. 1 further shows the vibrator arrangement 8 for purifying the collection chamber 5 by vibration. The vibrator arrangement is designed so that as the chamber is vibrated, the collected particles fall down and leave through the recovery channel 9. The collected substance can also be removed by rinsing with water.

The ion blow method is characterized by a corona effect achieved by high voltage so that the voltage intensity is increased so much that an ion blow effect is generated from the ion yield tips to the desired grounded structure. A number of ion yield tips to be calculated separately is needed for each gas separation application. The ion beam method has been described more closely, for example, in the patent publication EP-424 335.

A solution for purifying gas in a collection chamber with the help of an ion blow method according to the known technique has been presented in FIG. 2. The figure shows an outlet 2 for the purified gas, a grounded collection chamber 5 and an energized fastening rod 6, comprising several ion yield tips 7. In addition, the figure shows the ion blow 11, particle accruals 12, 13 and 14 in the collection chamber 5, and the gas flow 15. The solutions in FIGS. 1 and 2 are characterized by the position of the ion yield tips in rings 22, with the help of which the distance between the ion yield tips and the collection surface is made shorter.

Especially in industry, in which several kilogrammes of substance have to be separated from big gas flows in one second, the ion beam equipment is relatively large, specifically because of the high voltage used.

In several industrial lines, it is difficult to find the necessary space for the equipment in the ion blow method.

The object of the present invention is to provide a method and a device, with which materials in the form of particles and/or drops can be separated from the gas flow, and power demand may be radically decreased and the detaching methods for the particle material accumulated onto the collection plates may be improved.

SUMMARY OF THE INVENTION

In the method of the invention, impurities are separated from the gas flow by a push-pull method, which is characterized in that the electrically conductive collection surfaces are electrically insulated from the outer casings, and that high tension is applied to the conductive collection surfaces, the high tension having the opposite polarity to the high tension applied to the ion yield tips. Compared with the known ion blow method described above, the difference is that the method of the invention has an electric field between the ion yield tips and the walls of the collection chamber as additional power. When applying high tension to the conductive collection surfaces, an electric field is generated in front of the collection surface, urging ions and particles that are charged with the opposite polarity from the high tension applied to the conductive collection surface towards the collection surface. With the said push-pull method, a better separation is achieved so that ion yield tips do not need to be attached to the rings, but they may be attached directly to the fastening rod.

By using the method of the invention, the operating voltage decreases to ⅓–¼ in relation to the method of the known technique shown in FIG. 2. At the same time, costs for achieving the same amount of air and the same purity level decrease considerably, even to ⅓.

A further object of the invention is to provide a device for carrying out the method of the invention described above. It is characteristic of the device of the invention that the electrically conductive collection surfaces are electrically insulated from the outer casings, and that high tension is applied from the voltage source to the collection surfaces, the high tension having the opposite sign of direct voltage as the high tension applied to the ion yield tips. In an embodiment of the invention there is a void provided between the electrical insulation and the outer casing.

BRIEF DESCRIPTION OF THE DRAWINGS

The invention is next described in more detail, referring to the enclosed drawings in which.

DETAILED DESCRIPTION

Figure 1:
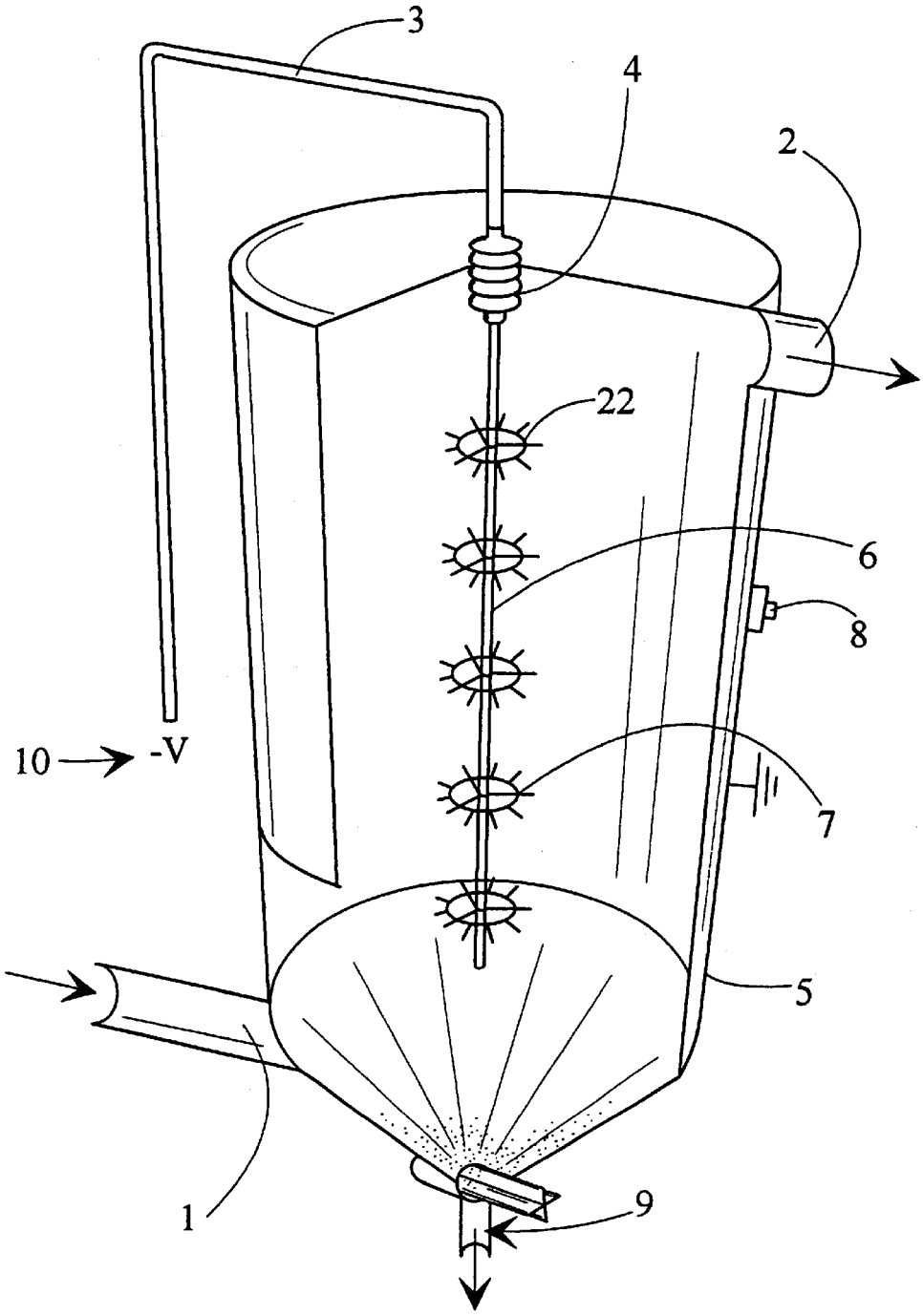
Fig. 1 PRIOR ART
FIG. 1 shows an equipment of the known technique used in the ion blow method.
Figure 2:
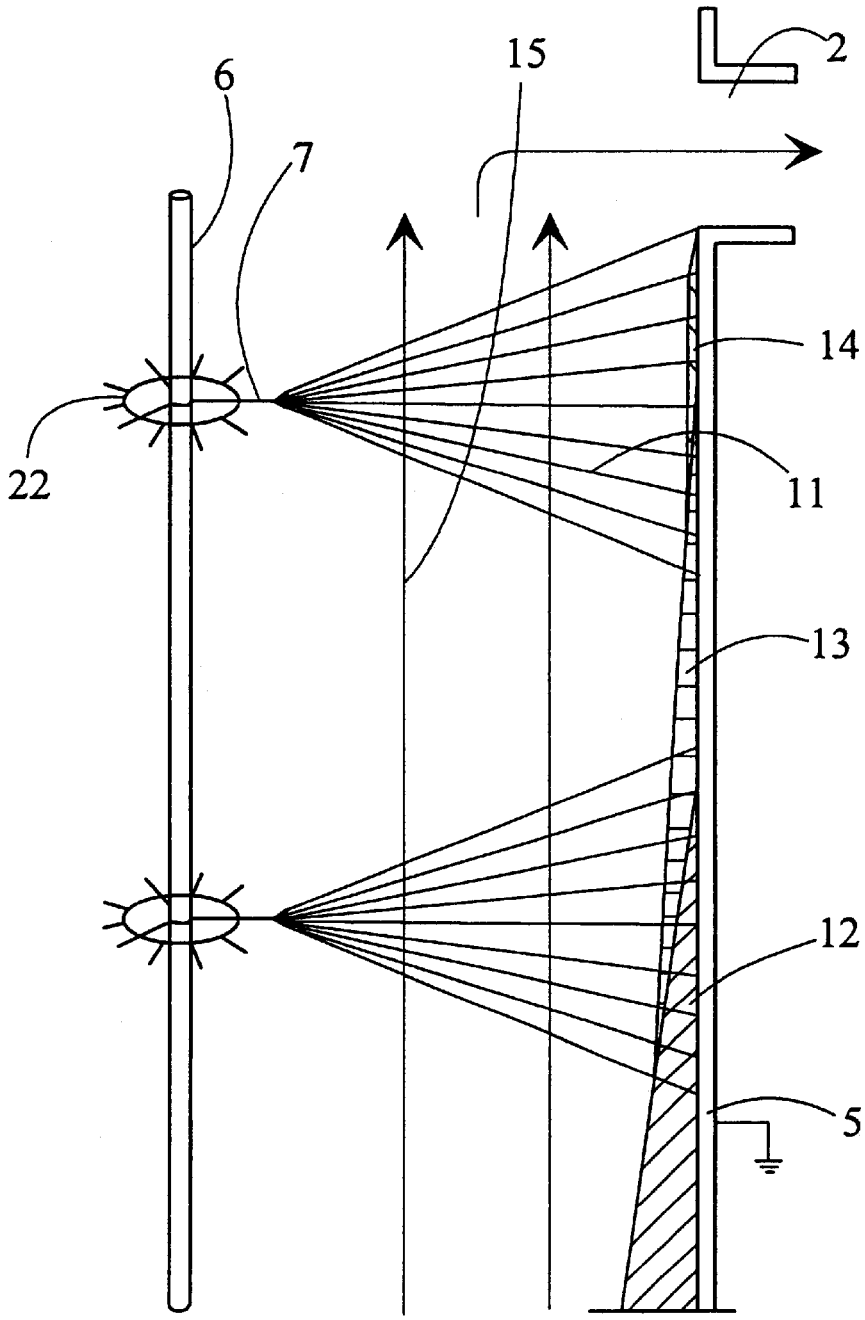
Fig. 2 PRIOR ART
FIG. 2 shows a method of the known technique for purifying gas with the help of the ion blow method.

FIGS. 1 and 2 have been described above. The solution of the invention is next described, referring to FIG. 3 showing an embodiment of the invention.

Figure 3:
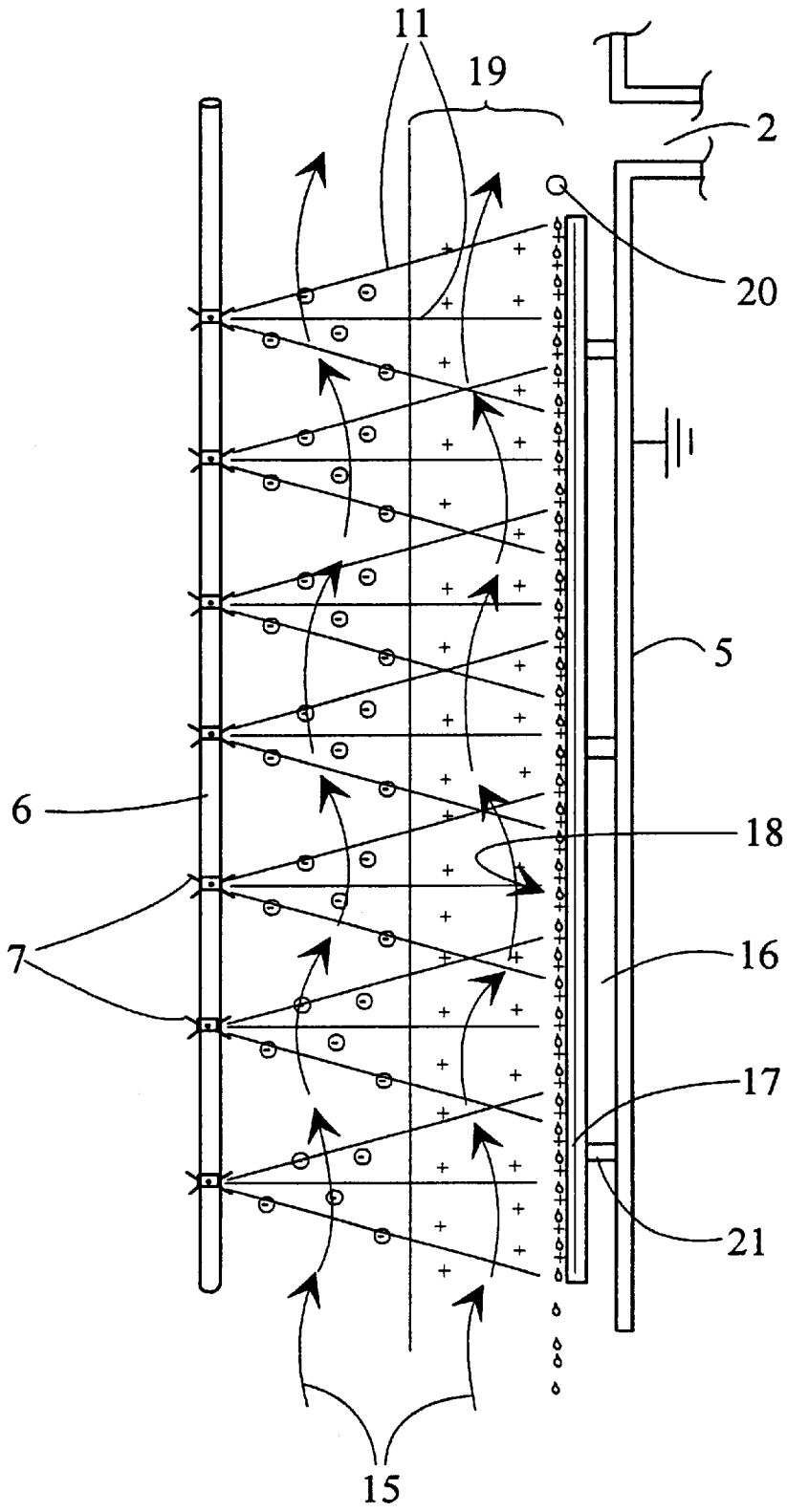
FIG. 3 shows the structure and the principle of operation of a separation device according to the invention.

FIG. 3 shows a separation device of the invention, its structure and principle of operation. The figure shows an outlet 2 for the purified gas, a grounded outer casing 5, and an energized fastening rod 6 comprising several ion yield tips 7.

Additionally, the figure shows ion beams 11 and a gas flow 15. Further, the figure shows an air gap 16 arranged between the outer casing 5 of the collection chamber and the electrical insulation layer 17, and an electrically conductive layer 18 on the interior surface of the electrical insulation layer 17. The electrical insulation layer 17 is attached to the outer casing 5 with the help of fasteners 21. Voltage with the opposite polarity of direct voltage, positive in the figure, as the high tension applied to the ion yield tips 7 (negative in the figure), is applied to the conductive layer 18. Thus, the voltages are opposite, i.e. positive for the ion yield tips 7 and negative for the conductive layer 18, or negative for the ion producing tips and positive for the conductive layer 18. The voltage of the ion yield tips 7 is substantially equal to that of the collection surface, i.e. the electrically conductive layer 18, but it is also possible to use voltages of different magnitude. The advantage of equal voltages is the simpler structure of high tension centres. Better purification results have also been achieved with equal voltages.

FIG. 3 further shows a void 19 charged with a positive electric field in front of the electrically conductive layer 18; the void 19 is positively charged, because positive high tension is applied to the layer 18. As the charge of the conductive layer 18 is reversed, i.e. in this case negative, the accumulated substance is released, and it falls to the recovery channel (reference number 9 in FIG. 1) in the bottom of the collection chamber, as the electric field then releases the accumulated particles. Thus, no vibration arrangements are needed in the device of the invention. However, they may be used when desired. The most common purification of the collection layer is carried out automatically by rinsing with liquid, it being then possible to program the desired purification interval and purification time. In liquid rinsing, the purification liquid is fed from the injection tube 20, and as it flows along the collection layer 18, the liquid removes the accumulated particles from the layer 18. When desired, it is also possible to use, for example, disinfectant in the purification agent.

As is shown above, by changing the charge of the conductive collection layer 18, the accumulated substance is either made to stay on the layer or detach therefrom. The charges used in the device are about 10–60 kV, preferably about 30–40 kV, and current about 0.05–5.0 mA, preferably about 0.1–3.0 mA.

The electrical insulation 17 arranged on the energized collection layer 18 and shown in FIG. 3 may be glass, plastic, or some other similar substance insulating high tension, preferably the insulation 17 is acrylic-nitrile-butadiene-styrene CABS).

Further, the planar electrically conductive layer shown in FIG. 3 and arranged on the electrical insulation layer 17 is made of metal, such as a thin metal plate or film on the insulation layer, or of a wire mesh arranged partially or entirely on the insulation id layer or inside it. Especially preferable is that the electrically conductive member comprises a hard chrome layer arranged on the insulation layer and provided by vacuum evaporation metallization. Also other metallization methods may be used, likewise adhesion of metal film, and other fastening methods.

With the method according to the invention, even very small solid particles in the form of particles and liquid drops may be efficiently separated from the gas flow. The treatment of gas takes place in chambers, tunnels or tubular structures, in which gas is directed to the ion beam. The ion beam generates an impulsive force for the material collected against the collection surface of the conductive layer and simultaneously charges electrically the particles that have capacitance. The electric charge provided on the collection surface, being of the opposite polarity, creates a traction force that urges the particles or materials in the form of drops towards the collection surface. Thus, the impulsive force of the ion beam and the traction force of the electric field are available for removing particles from the gas flow.

In the method according to the invention, the ion production may be of a type producing either negative or positive ions.

The ion beam equipment according to the invention may be installed, for example, in genetic research laboratories in which particles with a diameter of at least 1 nm may be released from DNA threads. In these laboratories, traditional electric filters do not work in a satisfactory way, as particles of the nanometric category cannot be electrically charged.

The gas purification according to the invention is usually conducted in air purification, very suitable uses then being also, for example, isolation rooms in hospitals, operating rooms, factories manufacturing micro chips, and air intake in such rooms in which biological weapons have to be repelled.

Thus, the uses of the invention may comprise all rooms, and the purification of intake air and exhaust air. Air purification in the particle and drop size of 1–100,000 nm is possible with the method of the invention, as well as the continuous purification of air also during the rinsing of collection surfaces when the voltage of the collection surface may be cut off, if the mode of rinsing requires plenty of liquid, The method according to the invention may further be applied in various purification equipments for gas and flue gas, for example in purification equipment based on current filters, cyclones, electric filters, material dividers or the ion blow method. The standard models of the method are suitable for the air purification of rooms in homes and offices.

With the method according to the invention, separation may be carried out for particles with a diameter from one nanometer to particles of the size of hundreds of micrometers, Neither is the specific gravity nor the electrical capacitance of the particles an obstacle for separation. Gas may be purified for the part of different particle sizes up to pure gases.

It is obvious for one skilled in the art that the method and device for separating materials in the form of particles and/or drops from a gas flow are not limited to the example described above, but they are based on the following claims.

What is claimed is:

1. A method for separating particles of solid and/or liquid from a gas flow, comprising:

providing a collection chamber having an outer wall that is grounded and containing an ion yield tip and an electrically conductive collection member, the collection member being electrically insulated from the outer wall, directing the gas flow through collection chamber, between the ion yield tip and the collection member, applying a first voltage potential to the ion yield tip and applying a second voltage potential to the collection member, the first and second voltage potentials being of opposite respective polarities relative to the outer wall, so that a beam of ions of the polarity of the first voltage potential is emitted from the ion yield tip towards the collection member and separates the particles from the gas flow.

2. A method according to claim 1, wherein the first and second voltage potentials are such that a voltage of 10–60 kv and a current of 0.05–5.0 mA are established between the ion yield tip and the collection member.

3. A method according to claim 2, wherein the first and second voltage potentials are such that a voltage of 30–40 kv is established between the ion yield tip and the collection member.

4. A method according to claim 2, wherein the first and second voltage potentials are such that a current of 0.1–3.0 mA is established between the ion yield tip and the collection member.

5. A method according to claim 1, further comprising changing the second voltage potential so that particles accumulated on the collection member become detached from the collection member.

6. A method according to claim 1, comprising rinsing the collection member with liquid in order to remove particles accumulated on the collection member.

7. Apparatus for separating particles of solid and/or liquid from a gas flow, comprising:

a collection chamber having an outer wall and defining an inlet for the gas flow and an outlet for the gas flow, a means for grounding said outer wall, an ion yield tip located in the collection chamber, an electrically conductive collection member located in the collection chamber and electrically insulated from said outer wall, a voltage source for connecting a first voltage potential to the ion yield tip and a second voltage potential to the collection member, the first and second voltage potentials being of opposite respective polarities relative to ground, whereby a beam of ions of the polarity of the first voltage potential is emitted from the ion yield tip towards the collection member.

8. Apparatus according to claim 7, wherein the collection member is attached to an electrically insulating member and the insulating member is spaced from said outer wall.

9. Apparatus according to claim 7, wherein the collection member is attached to an electrically insulating member of glass or plastic.

10. Apparatus according to claim 7, wherein the collection member is attached to an electrically insulating member of acrylic-nitrile-butadiene-styrene (ABS).

11. Apparatus according to claim 7, wherein the collection member is substantially planar and is made of metal.

12. Apparatus according to claim 7, wherein the collection member is attached to an electrically insulating member, the electrically insulating member is a layer of insulating material, and the collection member is a conductive layer attached to the insulating layer.

13. Apparatus according to claim 12, wherein the layer of insulating material has an interior surface presented towards the ion yield tip and the conductive layer is disposed at least partly on said interior surface.

14. Apparatus according to claim 13, wherein the conductive layer is a layer of wire mesh.

15. Apparatus according to claim 12, wherein the conductive layer is embedded in the insulating layer.

16. Apparatus according to claim 7, wherein the collection member is a thin metal layer.

17. Apparatus according to claim 16, wherein the collection member is a thin chrome layer.

18. Apparatus according to claim 12, wherein the collection member is a thin metal layer attached to the insulating layer by vacuum evaporation metallization.

* * * * *